US011192763B2

(12) United States Patent
Kritzer et al.

(10) Patent No.: US 11,192,763 B2
(45) Date of Patent: Dec. 7, 2021

(54) TILTING SCISSOR-LIFT FOR VEHICLES

(71) Applicant: BendPak, Inc., Santa Paula, CA (US)

(72) Inventors: Jeffrey S. Kritzer, Moorpark, CA (US); Donald R. Henthorn, Simi Valley, CA (US)

(73) Assignee: BendPak, Inc., Santa Paula, CA (US)

( * ) Notice: Subject to any disclaimer, the term of this patent is extended or adjusted under 35 U.S.C. 154(b) by 135 days.

(21) Appl. No.: 16/679,957

(22) Filed: Nov. 11, 2019

(65) Prior Publication Data

US 2020/0071141 A1 Mar. 5, 2020

Related U.S. Application Data

(63) Continuation-in-part of application No. 15/794,810, filed on Oct. 26, 2017, now Pat. No. 10,745,259.
(Continued)

(51) Int. Cl.

| | |
|---|---|
| ***B66F 7/06*** | (2006.01) |
| ***B66F 7/22*** | (2006.01) |
| ***B66F 7/08*** | (2006.01) |

(52) U.S. Cl.
CPC ..... *B66F 7/0683* (2013.01); *B66F 7/08* (2013.01); *B66F 7/22* (2013.01); *B66F 2700/123* (2013.01)

(58) Field of Classification Search
CPC ..... B66F 17/00; B66F 17/006; B66F 3/22; B66F 3/24; B66F 3/245; B66F 7/06;
(Continued)

(56) References Cited

U.S. PATENT DOCUMENTS 2,931,519 A 4/1950 Beach
2,937,852 A 5/1960 Clarke
(Continued)

FOREIGN PATENT DOCUMENTS

DE 4238733 A1 * 5/1994 ..... B66F 7/065
DE 29815972 U1 12/1998
(Continued)

OTHER PUBLICATIONS

Scissor Parking Lift, Lianhai Parking, http://www.lianhaiparking.com/parking-lift/scissor-parking-lift/; published at least as early as Sep. 8, 2016; admitted prior art; Exhibit A.
(Continued)

*Primary Examiner* — Tyrone V Hall, Jr.
(74) *Attorney, Agent, or Firm* — Erickson Kernell IP, LLC; Kent R. Erickson

(57) ABSTRACT

A parking lift for vehicles. The parking lift includes a platform on which a vehicle can be parked and lifted by a pair of scissor-lifts configured to raise and lower the platform to enable parking of a second vehicle beneath the platform. A deck of the platform is provided with a gradual slope throughout its length to enable vehicles with low ground clearance to travel onto the platform without contacting an underside of the vehicle with the deck. Each of the scissor-lifts includes short leg and a long leg that is longer than the short leg. Upon actuation between lowered and raised positions, the legs raise an entry end of the platform a greater vertical distance than an opposite terminal end. The platform is thus tilted upward to place a deck thereof in a substantially level or downwardly sloping orientation from the entry end toward the terminal end.

18 Claims, 9 Drawing Sheets

Related U.S. Application Data

(60) Provisional application No. 62/413,779, filed on Oct. 27, 2016.

(58) Field of Classification Search
CPC ..... B66F 7/065; B66F 7/0691; B66F 7/08; B66F 7/085; B66F 7/0683; B66F 7/10; B66F 7/16; B66F 7/28
See application file for complete search history.

(56) References Cited

U.S. PATENT DOCUMENTS

| | | | | |
|---|---|---|---|---|
| 3,317,004 | A | 5/1967 | Harrison, Jr. | |
| 4,724,930 | A | 2/1988 | VanLierop | |
| 4,753,419 | A | 6/1988 | Johansson | |
| 4,901,980 | A * | 2/1990 | Hansen | B25H 1/0007 254/124 |
| 4,995,130 | A | 2/1991 | Hahn et al. | |
| 5,040,637 | A | 8/1991 | Hawk | |
| 5,207,333 | A | 5/1993 | Peng | |
| 5,967,494 | A | 10/1999 | Fiorese | |
| 8,469,152 | B2 | 6/2013 | Olsen et al. | |
| 8,827,246 | B2 | 9/2014 | Swasey et al. | |
| 10,745,259 | B2 | 8/2020 | Kritzer et al. | |
| 2003/0015376 | A1 | 1/2003 | Vignoli | |
| 2004/0069979 | A1 | 4/2004 | Hicks et al. | |
| 2009/0078509 | A1 | 3/2009 | Olsen et al. | |
| 2010/0243973 | A1 | 9/2010 | Deuring et al. | |
| 2011/0278517 | A1 | 11/2011 | Deuring et al. | |
| 2013/0256611 | A1 | 10/2013 | Ruth | |
| 2015/0321891 | A1 | 11/2015 | Mohr | |
| 2018/0044153 | A1 | 2/2018 | Nedelman | |
| 2018/0118539 | A1 | 5/2018 | Kritzer et al. | |

FOREIGN PATENT DOCUMENTS

| | | | |
|---|---|---|---|
| DE | 102016100095 | A1 | 7/2016 |
| EP | 0936177 | A1 | 8/1999 |
| JP | S63208500 | A | 8/1988 |
| JP | HEI7001214 | | 1/1995 |
| JP | H11247477 | A | 9/1999 |
| JP | 2011016618 | A | 1/2011 |
| WO | 2014035288 | A1 | 3/2014 |

OTHER PUBLICATIONS

Lilt Parking Lift, Lianhai Parking, http://www.lianhaiparking.com/parking-lift/tilt-parking-lift/; published at least as early as Sep. 8, 2016; admitted prior art; Exhibit B.

* cited by examiner

TILTING SCISSOR-LIFT FOR VEHICLES

CROSS-REFERENCE TO RELATED APPLICATIONS

This application is a continuation-in-part of and claims the benefit of U.S. patent application Ser. No. 15/794,810 filed Oct. 26, 2017 which claims the benefit of U.S. Provisional Patent Application No. 62/413,779 filed Oct. 27, 2016, the disclosures of each of which are hereby incorporated herein in their entirety by reference.

BACKGROUND

There are a variety of available vehicle lifts designed to raise a vehicle above a ground surface. These lifts are often employed to enable access to the underside of the vehicle for maintenance work. A particular segment of lifts, known as parking lifts, is configured to provide additional parking space by lifting one vehicle to a sufficient height to enable a second vehicle to be parked beneath the first. Parking lifts generally include a platform on which the vehicle to be raised is positioned, in contrast to lifts for maintenance which generally include one or more lifting arms rather than a platform so as to avoid obstructing access to the underside of the vehicle.

Parking lifts can take a variety of forms including post lifts that include one, two, four, or more vertical posts that support one or more platforms on which one or more vehicles can be disposed. Parking lifts may also include scissor-lifts that employ a plurality of pivotably connected legs arranged in a pantograph or crossing X-like pattern that are pivoted to extend or retract the overall length of the assembly and thus the height of a platform disposed thereon.

These known lifts suffer a variety of drawbacks. Many forms of lifts require the lifting structure to be anchored to the underlying surface to prevent toppling of structures when under load and require the underlying surface to be engineered to meet heightened standards to support the weight of the lift and vehicle. Many known lifts are designed to reduce space requirements for their installation and use but then suffer from being too constrained in available space in which to position the vehicle to be lifted and the vehicle to be positioned under the lifted vehicle. For example, the posts or scissor-lifts supporting the platform may obstruct opening of the doors of the vehicle parked underneath the platform. This makes entering and exiting the vehicle difficult and increases the risk of damaging the doors of the vehicle through contact with the lift. Known lifts also provide somewhat steep entrance ramps that are difficult for low-riding vehicles, such as sports cars, to traverse without the underside of the vehicle contacting the ramp and potentially damaging the vehicle.

SUMMARY

Exemplary embodiments are defined by the claims below, not this summary. A high-level overview of various aspects thereof is provided here to introduce a selection of concepts that are further described in the Detailed-Description section below. This summary is not intended to identify key features or essential features of the claimed subject matter, nor is it intended to be used in isolation to determine the scope of the claimed subject matter. In brief, this disclosure describes a vehicle parking lift that may be employed to sufficiently raise a first vehicle to enable a second vehicle to parked therebelow. The parking lift includes a platform on which the first vehicle can be parked. The platform includes a deck that is gradually sloped from one end downward toward an entry end to reduce the ground clearance necessary for the first vehicle to drive onto the platform.

The platform is raised by pairs of pivoting or scissoring legs disposed along opposing lateral sides of the platform. One leg of each pair is provided with a recessed portion that is recessed away from the midline of the parking lift and may include a pad disposed on the leg in the recessed portion. The recessed portion provides additional clearance for opening the doors of the second vehicle when parked beneath the platform and between the pairs of legs. The pad also provides additional protection against damaging the door by contact with the respective leg.

In another embodiment, the scissoring legs are configured to at least partially tilt the platform rearward as the platform is raised. A first leg of each pair of scissoring legs is provided with a first length and a coupling point located centrally along the first length. A second leg of each pair is provided with a second length that is longer than the first length and a coupling point that is not located centrally along the second length. When coupled at their respective coupling points and pivoted relative to one another, a first end of the first leg travels a shorter vertical distance than a first end of the second leg. Thus the entry end of the platform supported on the scissoring legs is at least partially tilted upward. The entry end of the platform is thus raised to a greater extent than an opposite end to provide additional clearance for a vehicle positioned beneath the platform.

DESCRIPTION OF THE DRAWINGS

Illustrative embodiments are described in detail below with reference to the attached drawing figures, and wherein.

DETAILED DESCRIPTION

Figure 1:
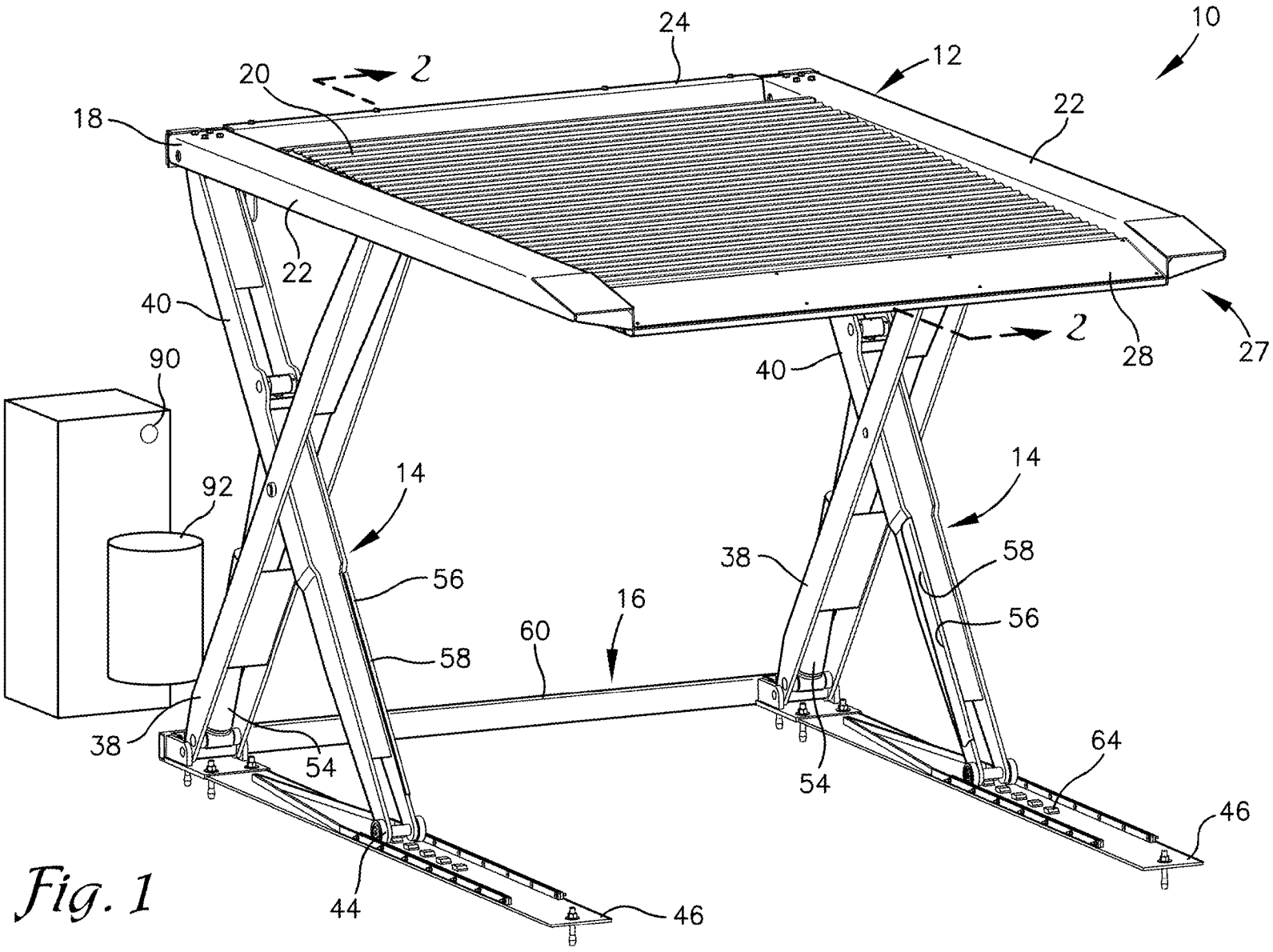
FIG. 1 is a perspective view of a vehicle parking lift depicted in accordance with an exemplary embodiment.
Figure 2:
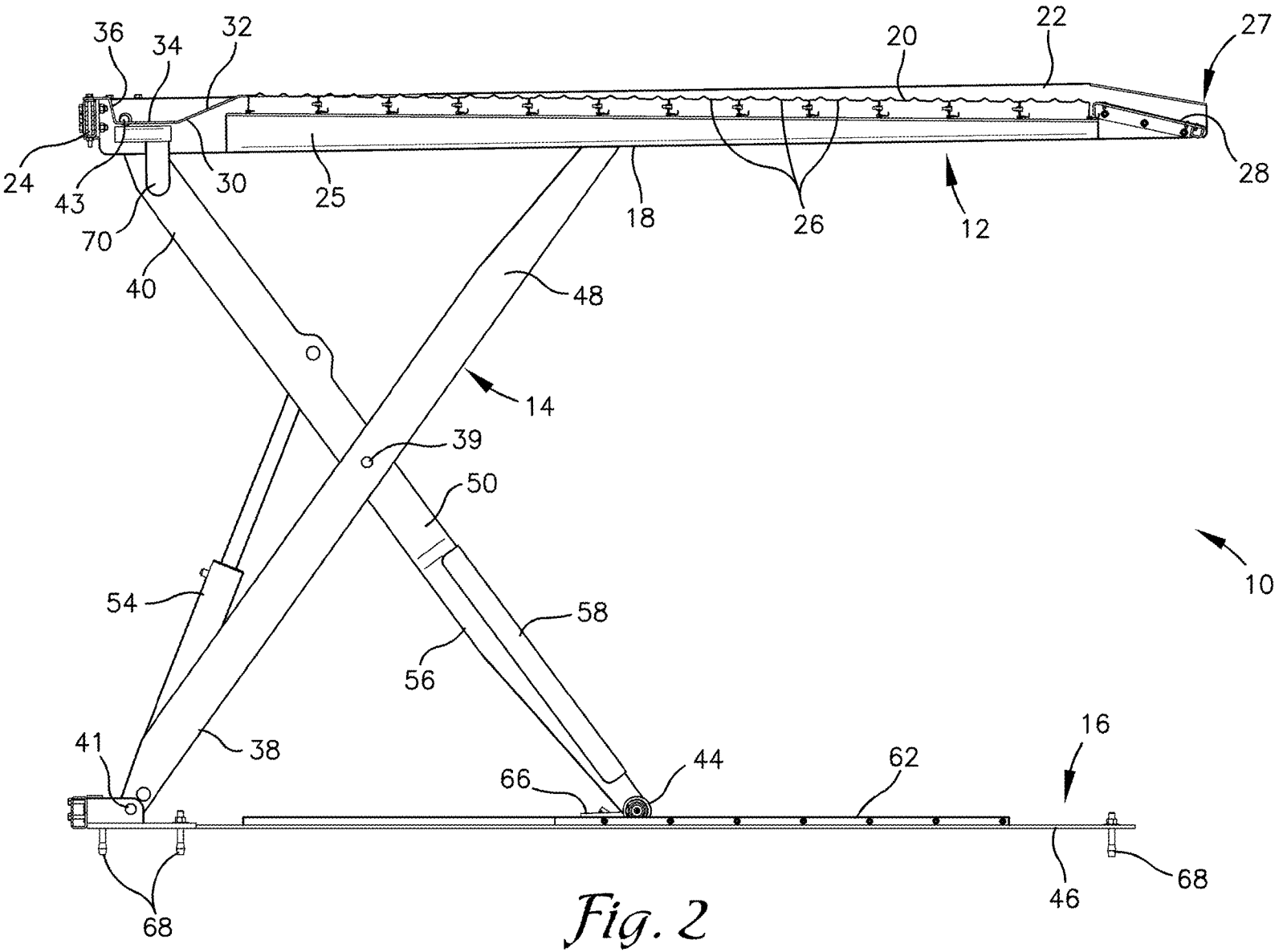
FIG. 2 is a cross-sectional view of the vehicle parking lift of FIG. 1 taken along the line 2-2 depicted in FIG. 1.

The subject matter of select exemplary embodiments is described with specificity herein to meet statutory requirements. But the description itself is not intended to necessarily limit the scope of claims. Rather, the claimed subject matter might be embodied in other ways to include different components, steps, or combinations thereof similar to the ones described in this document, in conjunction with other present or future technologies. Terms should not be interpreted as implying any particular order among or between various steps herein disclosed unless and except when the order of individual steps is explicitly described. The terms "about" or "approximately" as used herein denote deviations from the exact value by +/−10%, preferably by +/−5% and/or deviations in the form of changes that are insignificant to the function.

Exemplary embodiments are described herein with respect to the drawings in which reference numerals are employed to identify particular components or features. Similar elements in the various embodiments depicted are provided with reference numerals having matching second and third digits but with differing first digits, e.g. element 10 is similar to elements 110, 210, etc. Such is provided to avoid redundant description of similar features of the elements but is not intended to indicate the features or elements are necessarily the same.

With reference to FIGS. 1-6, a parking lift 10 is described in accordance with an exemplary embodiment. The lift 10 includes a platform 12 supported by a pair of scissor-lifts 14 which are mounted on a base 16. The platform 12 is configured to receive and support a vehicle on a top surface thereof while the scissor-lifts 14 raise the platform a sufficient distance to enable parking of a second vehicle beneath the platform 12. The lift 10 is described herein for use with vehicles such as common cars, light-duty pick-up trucks, sport-utility vehicles, and vans among other automobiles and for applications associated with parking such vehicles. The lift 10 is shown and described in a configuration designed for lifting a single vehicle. However, it is understood that in some embodiments the lift 10 may be configured for use with larger vehicles and/or multiple vehicles and may be employed for uses other than parking, e.g. vehicle maintenance work or theft deterrence.

The platform 12 comprises a frame 18 that supports a deck 20. The frame 18 includes side members 22 extending along opposite side edges of the deck 20 and an end member 24 that extends between terminal ends of the side members 22. The side members 22 each include a wedge-shaped deck-support member 25 disposed along an inside face thereof to extend from the side member 22 toward a centerline of the platform 12 a distance sufficient to support a lateral edge of the deck 20. The wedge shape of the deck-support member 25 provides a sloped top surface on which the deck 20 is disposed. The deck-support member 25 may be internally or externally reinforced to provide strength to sufficiently support the deck 20 throughout the length of the member 25, e.g. throughout portions thereof having reduced dimensions. The frame 18 may also include other braces, ribs, gussets, or other support members extending longitudinally, transversely, or otherwise beneath the deck 20 as needed to reinforce the deck 20 and/or the frame 18.

The deck 20 comprises a generally planar panel extending between the side members 22 and configured to support a vehicle thereon. The deck 20 may comprise a single one-piece construction, or the deck 20 can be formed from a plurality of elongate segments 26 disposed to lie parallel to one another and to extend between the side members 22 of the frame 18. The segments 26 can include overlapping and/or interlocking flanges, grooves, tabs, slots, ribs, channels or similar features that interconnect to couple the segments 26 together. The segments 26 may also be fastened together via one or more fasteners, welding, or the like. Alternatively, the segments 26 can be spaced apart, but the spacing should not be sufficient to impede travel of a vehicle wheel over the deck 20 generally perpendicularly to the length of the segments 26.

The deck 20 is disposed on the frame 18 with lateral edges thereof overlying the deck-support members 25 and may be coupled to the deck-support members 25 via one or more fasteners, welding, or the like. The wedge shape of the deck-support members 25 position the deck 20 at a slight angle such that the height of the deck 20 increases from an entry end 27 toward the end member 24. The angle of the deck 20 relative to the horizontal plane of the side members 22 is preferably between about 0° and about 10° or between about 0° and about 5° or about 1°.

Figure 3:
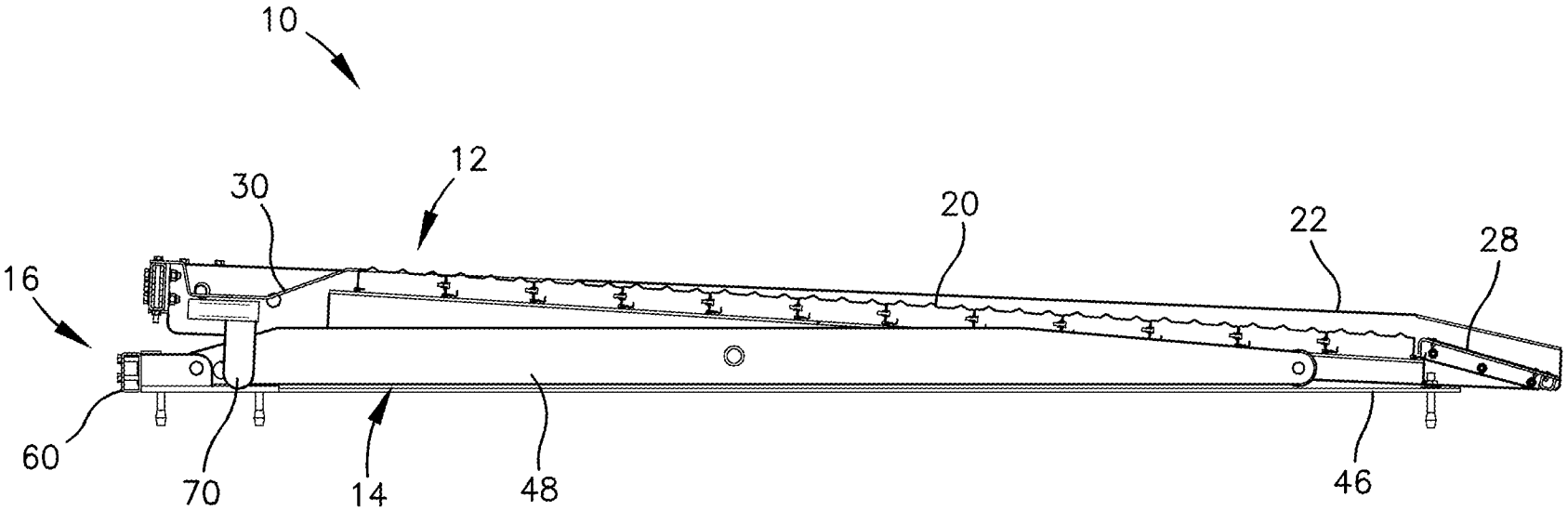
FIG. 3 is a cross-sectional view of the vehicle parking lift of FIG. 2 depicted in a lowered position in accordance with an exemplary embodiment.

An entry panel 28 is provided along the entry end 27 of the deck 20 and extending between the side members 22. As depicted in FIG. 3, when the lift 10 is in a lowered position, the entry panel 28 extends substantially between a ground surface and the entry end 27 of the deck 20. The vertical distance between the ground surface and the entry end 27 of the deck 20 that is traversed by the entry panel 28 is preferably less than about four inches or less than about three inches or more preferably less than about one inch. As such, the lift 10 can accommodate low ground clearance vehicles. The downward slope of the deck 20 aids to minimize the vertical distance that must be traversed by the entry panel.

The entry panel 28 may be positioned at a more aggressive angle than the deck 20, such as about 5° to about 15° or about 10° relative to the horizontal plane of the side members 22, or the entry panel may be positioned at the same or slightly increased angle relative to the deck 20, e.g. 0° to about 5°.

A wheel trough 30 is provided along an opposite end of the deck 20 between the deck 20 and the end member 24 of the frame 18 and extending between the side members 22. The wheel trough 30 is dimensioned to partially receive wheels of a vehicle to aid a user in properly positioning or locating the vehicle on the platform 12 and to resist the vehicle traveling beyond the end member 24 of the frame 18 and off of the lift 10. The wheel trough 30 may also function as a wheel chock to resist forward or rearward movement of the vehicle when parked. The wheel trough 30 includes a sloped wall 32, a base wall 34, and a stop wall 36. The sloped wall 32 slopes gradually downward from the edge of the deck 20 to the base wall 34 upon which the wheels of the vehicle can rest when parked on the lift 10. The stop wall 36 extends vertically upward from the base wall 34 at a sharp angle, e.g. approximately 90°, and a sufficient distance to at least partially resist travel of the vehicle wheels over the stop wall 36. The stop wall 36 may provide the driver of the vehicle with a physical or "tactile" indication that can be felt while driving the vehicle onto the lift 10 that notifies the driver to stop.

The scissor-lifts 14 generally mirror one another and include a lower-pivot leg 38 and an upper-pivot leg 40 that are pivotably coupled together near their midpoints at a pivot point 39. The lower-pivot leg 38 includes a pivotal coupling 41 with the base 16 at one end (its lower end when the deck 20 is raised) and includes a roller 42 disposed at an opposite end that contacts and rolls along an underside of a respective one of the side members 22 of the frame 18. The side member 22 may form a channel or track within which the roller 42 is received.

The upper-pivot leg 40 includes a pivotal coupling 43 with the frame 18 at one end (its upper end when the deck 20 is raised) and includes a roller 44 at a distal end thereof that contacts and rolls along a longitudinal member 46 of the base 18. The lower-pivot leg 38 and the upper-pivot leg 40 are thus configured in a crossing or X-shaped arrangement in which their respective rollers 42, 44 are generally vertically aligned as are their pivotal couplings 41, 43 with the base 16 and the frame 18, respectively.

In the embodiment shown, both the lower-pivot leg 38 and the upper-pivot leg 40 are comprised of a pair of spaced apart, generally planar, elongate members (the lower-pivot leg 38 including elongate members 48 and the upper-pivot leg 40 including an inner elongate member 50 and an outer elongate member 52) with one or more gussets 53 extending therebetween. The spacing between the elongate members 48 of the lower-pivot leg 38 is slightly greater than that of the inner and outer elongate members 50, 52 of the upper-pivot leg 40 such that the upper-pivot leg 40 fits between the elongate members 48 of the lower-pivot leg 38. The gussets 53 on each of the legs 38 and 40 are positioned to not interfere with pivotal movement of the legs 38 and 40 relative to one another within a desired range of motion.

Figure 4:
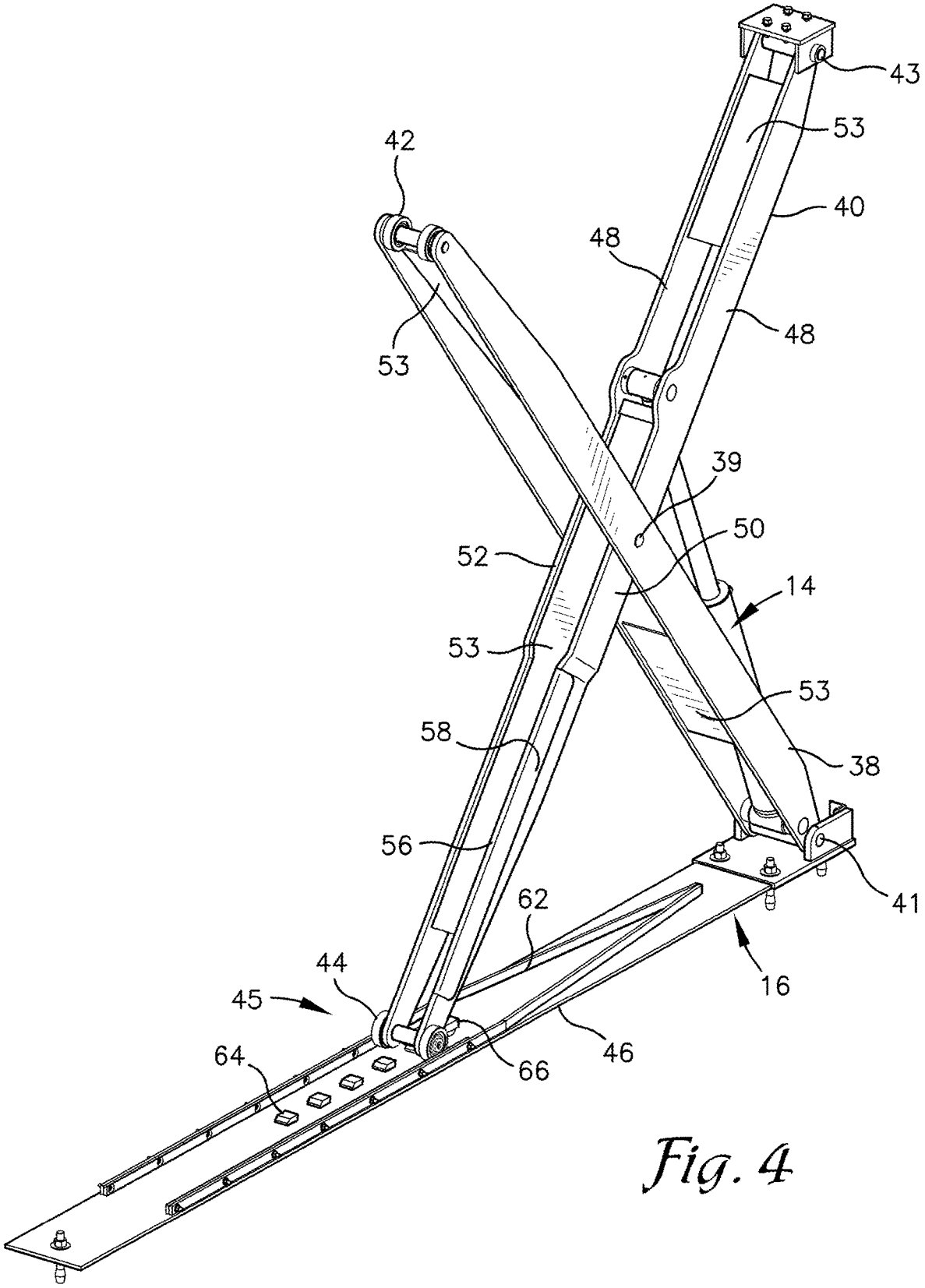
FIG. 4 is a partial perspective view of one leg of the vehicle parking lift of FIG. 1.

An actuator 54, such as a hydraulic or pneumatic linear actuator, is coupled between the legs 38 and 40. As depicted in FIG. 4, the actuator 54 is coupled to the lower-pivot leg 38 near the leg's pivotal coupling 41 with the base 16. The actuator 54 is further coupled to the upper-pivot leg 40 at a point spaced between the pivot point 39 and the pivotal coupling 43 between the upper-pivot leg 40 and the frame 18. Extension of the actuator 54 thus pivots the legs 38, 40 relative to one another in a first direction while retraction of the actuator 54 pivots the legs 38, 40 in the opposite direction relative to one another.

The inner elongate member 50 of the upper-pivot leg 40 is disposed closer to the platform 12 or to the centerline of the lift 10 than outer elongate member 52 and includes a recessed portion 56 extending along at least a portion of the distance between the roller 44 and the pivotal coupling with the lower-pivot leg 38. The recessed portion 56 is preferably recessed between about 0.5 inches to about 1.5 inches or at least about 0.66 inches from the plane of the outer surface of the non-recessed portion of the inner elongate member 50, but may be recessed a greater or lesser extent without departing from the scope described herein.

A bumper or pad 58 is preferably disposed on an inner surface of the inner elongate member 50 within the recessed portion 56. The pad 58 is preferably formed of a material that is resilient or softer than the metal forming a car door and may comprise a rubber, plastic, foam, or similar material useable to soften or cushion an impact of an object, such as a vehicle door with the scissor-lift 14 and/or to reduce the likelihood of such an impact denting, scratching, or otherwise damaging the object. The pad 58 may lie only along the face of the recessed portion 56 or may also wrap at least partially around edges thereof. The pad 58 preferably has a thickness that is less than the depth of the recess. For example, the pad 58 may have a thickness of about 0.25 inches. Provision of the pad 58 within the recessed portion 56 prevents the pad 58 from interfering with the movements of the legs 38, 40 and from being sheared off by such movements. The opposite or outer elongate member 52 of the upper-pivot leg 40 may include a similar recessed portion and pad.

As depicted in FIG. 1, the base 16 includes a pair of the longitudinal members 46 with a cross-member 60 extending between first ends thereof to form a generally U-shaped arrangement. The longitudinal members 46 each comprise generally planar plates with raised ribs 62 extending along their length. The ribs 62 provide a track in which the rollers 44 of the upper-pivot legs 40 can move and may reinforce the longitudinal members 46 against bending. A plurality of safety stops 64 are disposed spaced apart along a portion of the length of the longitudinal members 46 and within the track formed by the ribs 62. The safety stops 64 are engageable by a safety lock 66 disposed on the upper-pivot legs 40 as described more fully below. The base 16 may include one or more apertures through which fasteners 68 can be installed to anchor the lift 10 to an underlying surface.

The safety lock 66 comprises an arm 72 that is pivotably coupled to the distal end of the upper-pivot leg 40 between the inner and outer elongate members 50, 52 and adjacent the roller 44. The arm 72 may be coupled around or to an axle or pin (not shown) extending between the wheels of the roller 44 or may include a bore through which the axle or pin is received. The arm 72 extends from the distal end of the upper-pivot leg 40 rearward toward the cross-member 60 of the base 16 and includes a locking lug or tab 74 on a bottom surface thereof.

Figure 5A:
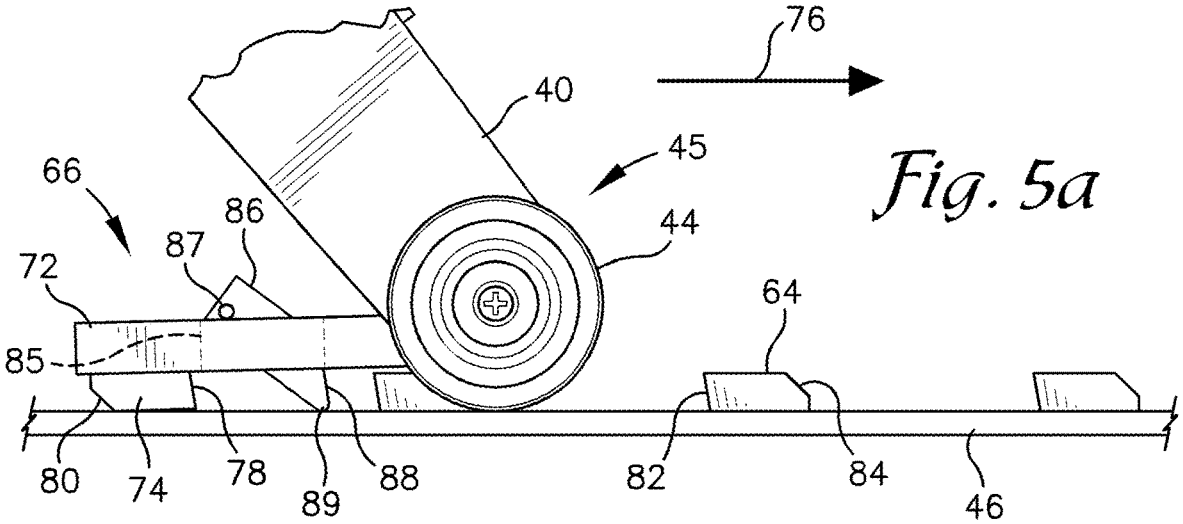
FIGS. 5*a-e* are enlarged partial side elevational views of a safety lock on a leg of the vehicle parking lift of FIG. 1 depicting a locking sequence in accordance with an exemplary embodiment.
Figure 5B:
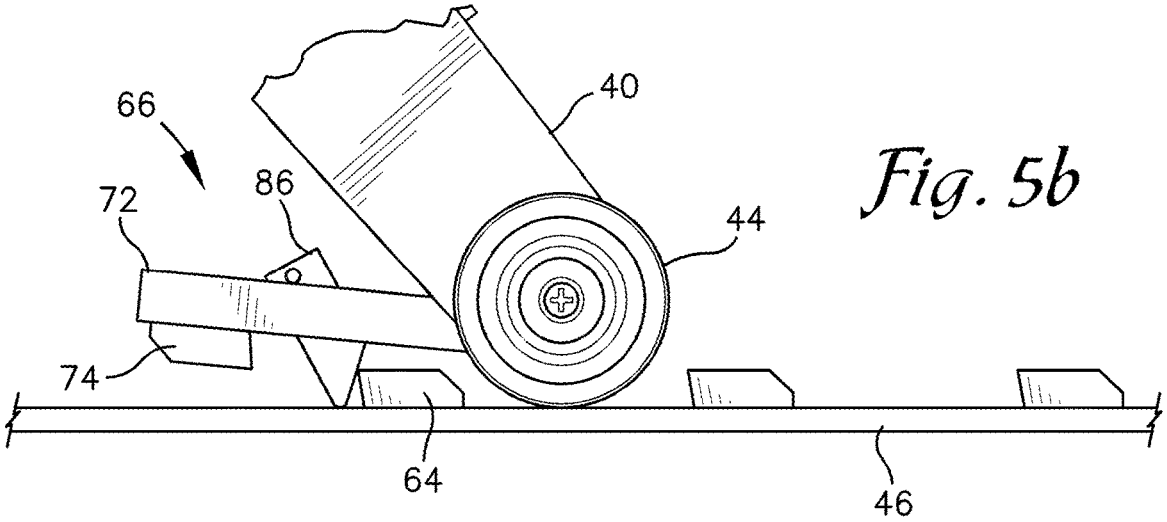

The locking tab 74 is configured to cooperate with the safety stops 64 on the longitudinal member 46 of the base 16 to prevent movement of the distal end of the upper-pivot leg 40 in a forward direction (indicated by arrow 76 in FIG. 5*a*) and to enable movement in a reverse, rearward direction. As such, the locking tab 74 includes a locking face 78 on a forward end thereof and a pivot face 80 on an opposite rearward end. Similarly, the safety stops 64 include a stop face 82 on a rearward end thereof and a slide face 84 on a forward end. The locking face 78 and the stop face 82 are provided at substantially the same angle, which may be sloped slightly rearward, such that contact between the locking face 78 and the stop face 82 obstructs forward movement of the distal end of the upper-pivot leg 40 and resists pivotal movement of the arm 72 upward away from the base 16, as depicted in FIG. 5*e*. Conversely, the pivot face 80 and the slide face 84 are provided at a greater rearward sloping angle and are configured to cause the arm 72 to pivot upwardly away from the base 16 when the distal end of the upper-pivot leg 40 is moved rearward and the pivot and slide faces 80, 84 are brought into contact.

The arm 72 also includes a trigger plate 86 that is pivotably coupled to the arm 72 between the upper-pivot leg 40 and the locking tab 74. The trigger plate 86 is coupled to the arm 72 via a pivot pin 87 that may be coupled to the arm 72 along a top surface thereof and extends through a slot 85 in the arm 72 and into contact with the longitudinal member 46 of the base 16. The trigger plate 86 has a generally planar, rectangular form but includes a sloped forward edge 88, e.g. a forward top corner of the rectangular form is removed to provide the sloped forward edge 88 and a point 89 at a forward bottom corner thereof.

Figure 5C:
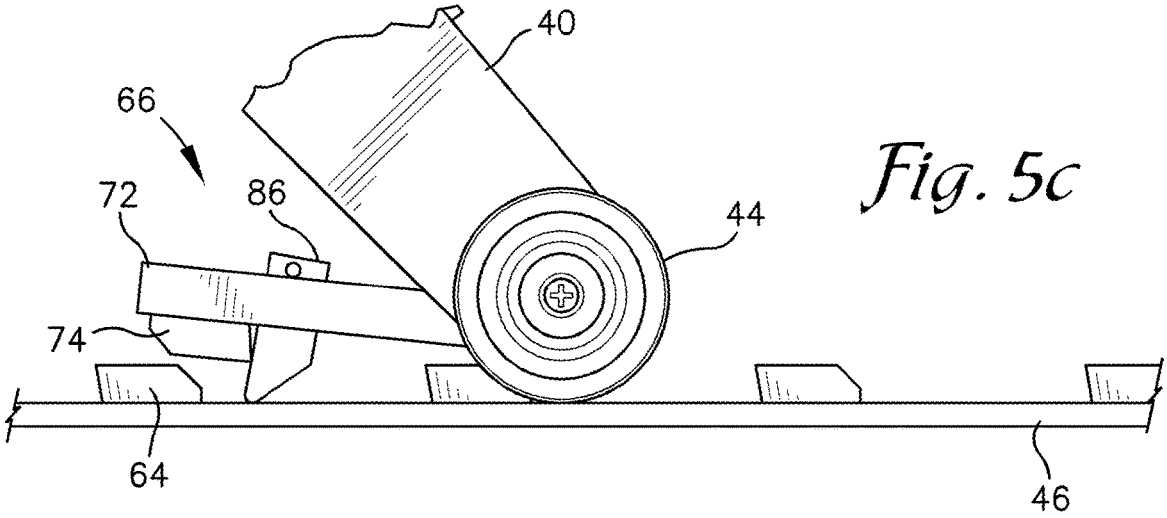

The trigger plate 86 has a length between its coupling with the pivot pin 87 and the point 89 sufficient to provide an over-center condition when pivoted between a forward-tilted, arming orientation (FIG. 5*a*) and a rearward-tilted, deployed orientation (FIG. 5*c*). The slot 85 in which the trigger plate 86 is disposed and/or the position of the trigger plate 86 relative to the locking tab 74 may limit or define the range of motion of the trigger plate 86 and thus the orientation of the trigger plate 86 in the arming and deployed orientations.

In the arming orientation depicted in FIG. 5*a*, the point 89 contacts and slides along the longitudinal member 46 of the base and the sloped forward edge 88 of the trigger plate 86 is positioned to contact the stop face 82 of one of the safety stops 64 as the distal end of the upper-pivot leg 40 is moved forward. Upon contacting the stop face 82 the trigger plate 86 is caused to pivot rearwardly (clockwise as depicted in FIGS. 5*a-e*) which in turn causes the arm 72 to be raised or pivoted upward (clockwise), as depicted in FIG. 5*b*. The trigger plate 86 continues to rotate past a generally vertical position or over center to the deployed orientation and is maintained in the deployed orientation by the over-center condition. The trigger plate 86 then slides along the longitudinal member 46 and over the safety stops 64 as the distal end of the upper-pivot leg 40 is moved forward and prevents the locking tab 74 from engaging the safety stops 64.

Figure 5D:
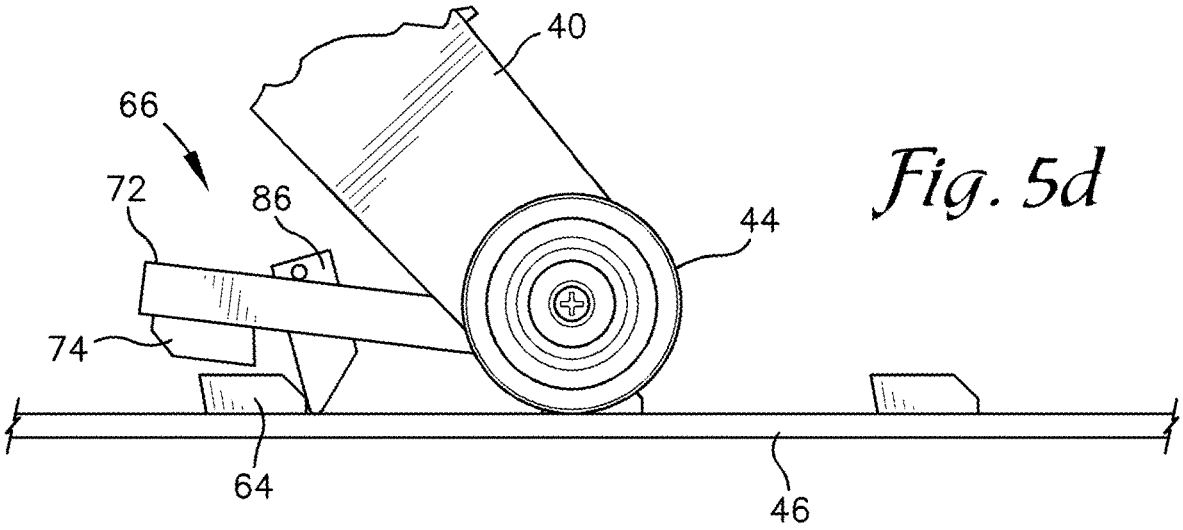
Figure 5E:
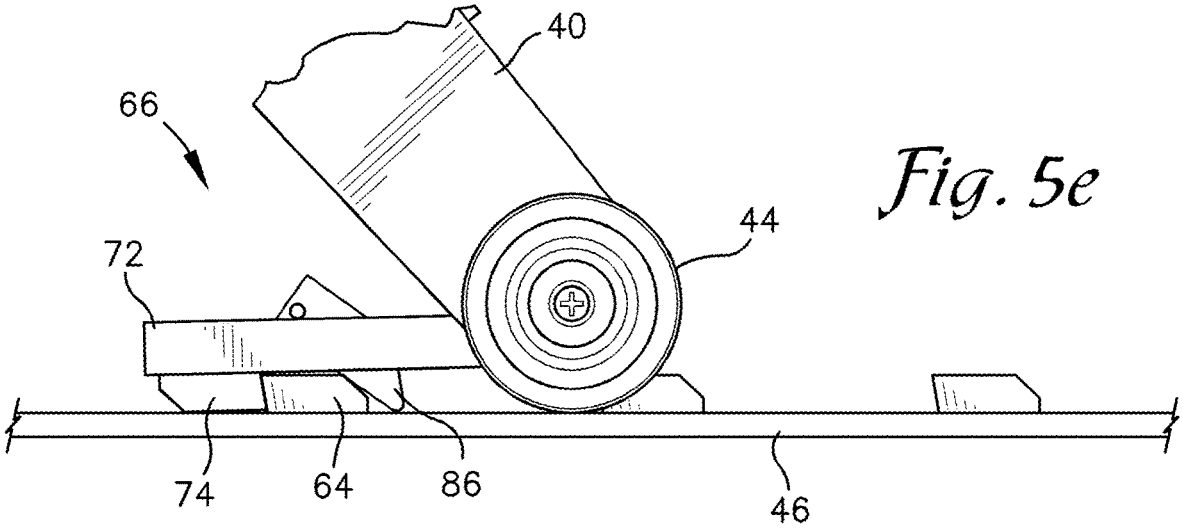

In the rearward direction, the point 89 of the trigger plate 86 slides along the longitudinal member 46 until contacting the slide face 84 or forward end of one of the safety stops 64 as depicted in FIG. 5*d*. Contact with the safety stop 64 pivots the trigger plate 86 forward (counter-clockwise), past the center of the over-center arrangement and allows the arm 72 to pivot downward (counter-clockwise). The rearward movement continues at least until the locking tab 74 is allowed to move downward into contact with the longitudinal member 46. The distal end of the upper-pivot leg 40 is then again moved forward to bring the locking face 78 of the locking tab 74 into contact or engagement with the stop face 82 of the safety stop 64, as depicted in FIG. 5*e*. The distal end of the upper-pivot leg 40 is thus restricted against further forward movement and the platform 12 is thus prevented from moving or dropping downward.

To again enable forward movement of the distal end of the upper-pivot leg 40, e.g. to lower the platform 12, the distal end of the upper-pivot leg 40 is first moved rearward. The trigger plate 86 pivots forward to allow the safety stop 64 to pass. After the trigger plate 86 moves past the safety stop 64, the distal end of the upper-pivot leg 40 can again be moved forward to cause the trigger plate 86 to contact the stop face 82 of the safety stop 64 and pivot the trigger plate 86 to the deployed orientation as described previously above. Although a particular configuration of the safety lock 66 is described, it is understood that other safety lock configurations may be employed without departing from the scope of exemplary embodiments.

With continued reference to FIGS. 1-6, operation of the parking lift 10 is described in accordance with an exemplary embodiment. The lift 10 is preferably dimensioned to fit within a standard parking space, e.g. an area approximately 7-10 feet wide and about 10-20 feet long or preferably about 8.5 feet wide and about 13.5 feet long. As such, the lift 10 can be easily positioned in available spaces in a parking lot or within most garages.

The lift 10 is placed in a lowered position, as depicted in FIG. 3, in which the actuator 54 is substantially retracted and the rollers 42, 44 are moved to their forwardmost positions along the respective side members 22 of the frame 18 or the longitudinal members 46 of the base 16. In the lowered position, ears 70 that extend downwardly from each of the side members 22 of the frame 18 contact the base 16 or the underlying surface to cause the platform 12 to tilt forward, e.g. the end member 24 of the frame 18 is maintained at a greater vertical height than the entry panel 28 which is moved into contact or very nearly into contact with the underlying surface. In another embodiment, the ears 70 support the platform 12 in the tilted forward orientation while the actuation of the scissor-lifts 14 causes the forward tilt in the platform 12.

In the forward-tilted orientation, the deck 20 of the platform 12 is placed at an angle of about 0° to about 15°, or about 3° to about 8°, or preferably about 5° while the entry panel 28 is placed at angle of about 10° to about 20°, or about 15°. As such, a vehicle traveling onto the platform 12 encounters and traverses a very gradual incline throughout the length of the platform 12. This enables very low profile vehicles, such as sports cars and other vehicles with very low ground clearance to travel onto the platform 12 without contact being made between the underside of the vehicle and the platform 12. In contrast, lifts available in the art provide a substantially horizontal platform with a steep entry panel having a much larger vertical rise which cannot be cleared by many vehicles with low ground clearance, e.g. vehicles having a ground clearance as low as about three inches.

To load the vehicle onto the platform 12, the vehicle is driven onto the deck 20 and forward until the leading wheels thereof reach the wheel trough 30. The wheels of the vehicle travel down the sloped wall 32 of the wheel trough 30 to the base 34 and may contact the stop wall 36. The stop wall 36 is configured to stop the vehicle when traveling at very slow or idle speeds and/or provides a bump which notifies the driver to stop the vehicle. The vehicle is stopped, parked, and the engine turned off by common methods. The driver then exits the vehicle.

A control panel 90 is accessed to initiate a hydraulic or pneumatic pump 92 and control system configured to operate the actuators 54. Operation of the actuators 54 pivots the lower-pivot legs 38 about their respective couplings with the base 16 to move the rollers 42 upward and longitudinally along the respective side members 22. Upward pivoting of the lower-pivot legs 38 also operates to move the upper-pivot legs 40 via the coupling of the upper-pivot legs 40 with the lower-pivot legs 38. Movement of the upper-pivot legs 40 also pivots the upper-pivot legs 40 about their respective couplings with the frame 18 of the platform 12 and moves their respective rollers 44 along the longitudinal members 46 of the base 16. The legs 38, 40 thus pivot from a generally horizontal position toward a more vertical orientation in a scissoring or crossing fashion. Pivoting of the legs 38, 40 lifts the platform 12 vertically upward and may at least partially tilt the platform 12 to move the entry end 27 upward relative to the opposite end of the platform 12 and thus move the deck 20 to a more horizontal or upwardly tilted orientation.

The platform 12 can be moved upward to a desired extent. A plurality of stops or positions may be provided between the lowered position and a fully raised position. Each of the stop positions may be defined by the position of the safety stops 64 on the base 16. Upon reaching a desired vertical height the safety locks 66 on the scissor-lifts 14 engage the respective safety stops 64 as described previously above.

Figure 6:
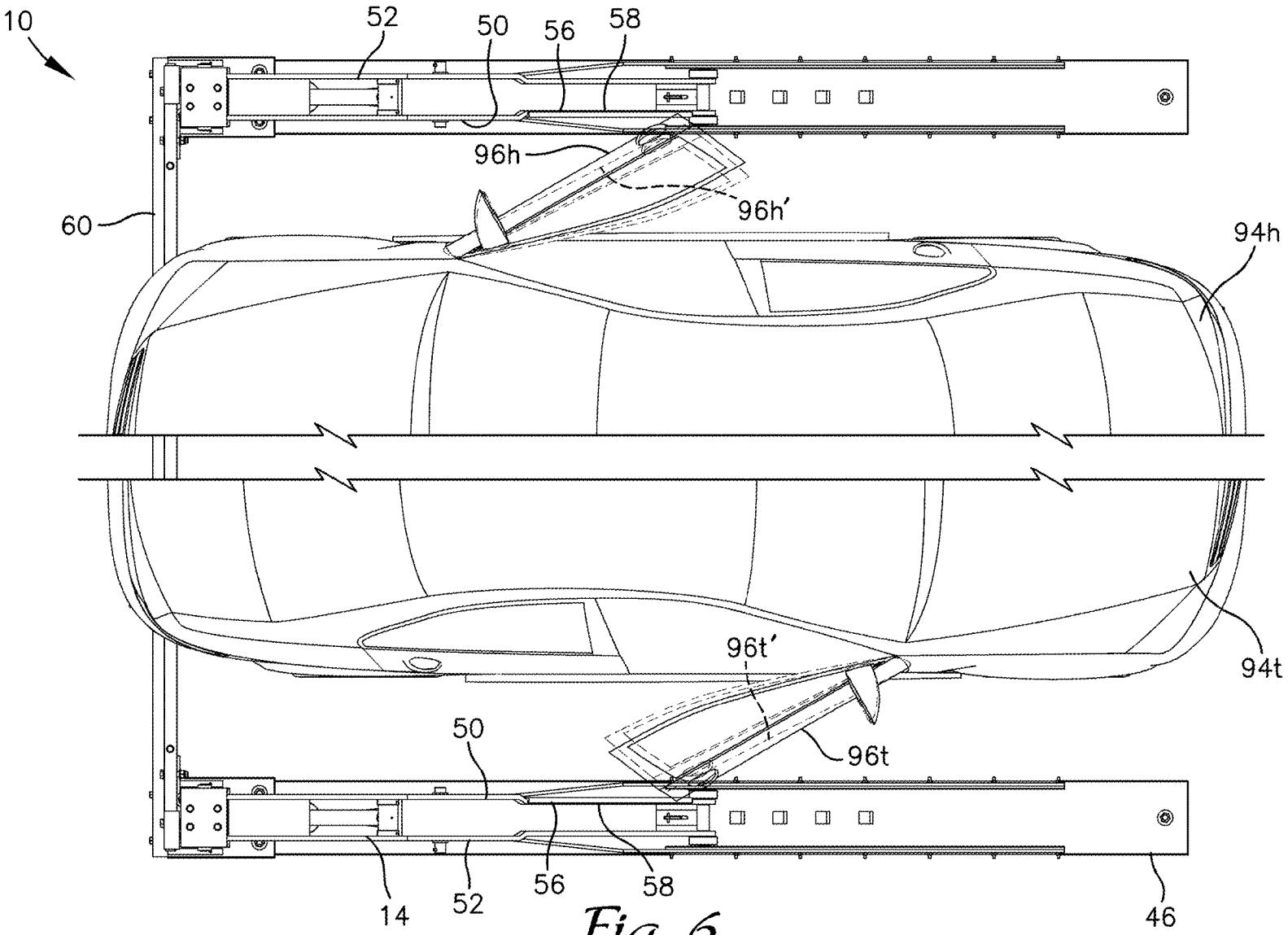
FIG. 6 is top plan view of the vehicle parking lift of FIG. 1 depicted with a platform removed and with a vehicle parked beneath the platform in both a head-in and a head-out orientation and depicting an increased range of motion provided by the vehicle parking lift for a door of the vehicle.

Preferably, the platform 12 is raised to a height sufficient to position a second vehicle 94 beneath the platform 12, however such is not necessary if it is not desired to position the second vehicle therebelow. As depicted in FIG. 6, the second vehicle 94 can be parked beneath the platform 12 in either a head-in position (94*a*) or a tail-in position (94*b*). In either position, the vehicle 94 is driven between the scissor-lifts 14 and may employ the cross-member 60 of the base 16 as a bump stop to indicate when to stop the vehicle.

When parked beneath the platform 12, a door 96 of the vehicle 94 is generally in proximity to the adjacent scissor-lift 14 and more particularly to the inner elongate member 50 of the upper-pivot leg 40. The recessed portion 56 of the elongate member 50 provides additional room for opening the door 96 and enables the door 96 of the vehicle 94 to open to a greater extent before contacting the leg 40 than would be possible if the inner elongate member 50 were completely planar. FIG. 6 provides an exemplary view of the vehicle 94 parked under the platform 12 in a head-in position (96*h*) and a tail-in position (94*t*). The vehicle door 96*h*, 96*t* is depicted opened to the extent possible with the recessed portion 56 in the elongate member 50. The vehicle door 96*h*', 96*t*' is also shown (in phantom lines) opened to the extent possible without the recessed portion 56 which is considerably less than that possible with the recessed portion 56.

The pad 58 disposed in the recessed portion 56 also aids to resists damaging the vehicle door 96 if contact is made between the door 96 and the leg 40. Removal of the vehicles from the lift 10 is completed by the reverse of the above described process.

A variety of enhancements may be provided on the lift 10 to increase safety and usability of the lift 10. For example, a key switch may be provided on the control panel 90 which can be employed to fully disable operation of the lift 10. Sensors, such as ultrasonic sensors, infrared sensors, proximity sensors, and cameras, among others may be provided to sense the presence of the second vehicle 94, and to aid positioning of the vehicles on and under the platform 20, among other uses. In some embodiments, the lift 10 may be provided as one of a plurality of lifts 10 that may be joined to a single controller or controlling system and/or power source. For example, a plurality of lifts 10 might be coupled to a single power unit that provides hydraulic power to each of the lifts 10 which are further controlled via independent operating controls that are co-located with each individual lift 10.

Figure 7:
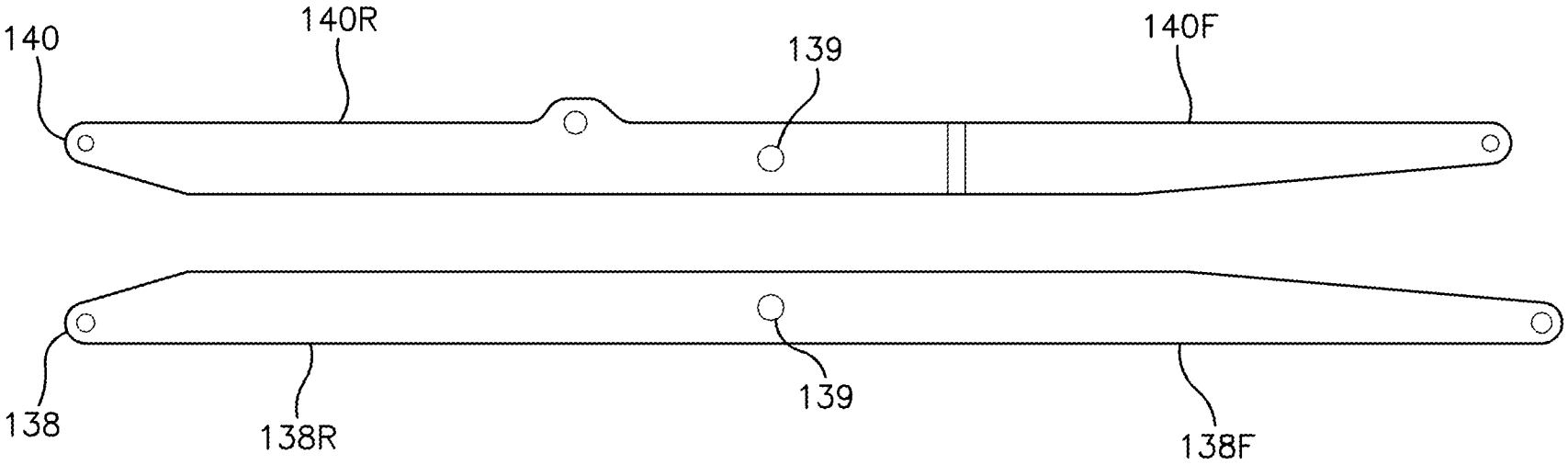
FIG. 7 is a side elevational view of a lower-pivot leg and an upper-pivot leg of a tilting vehicle parking lift depicted in accordance with an exemplary embodiment.
Figure 8:
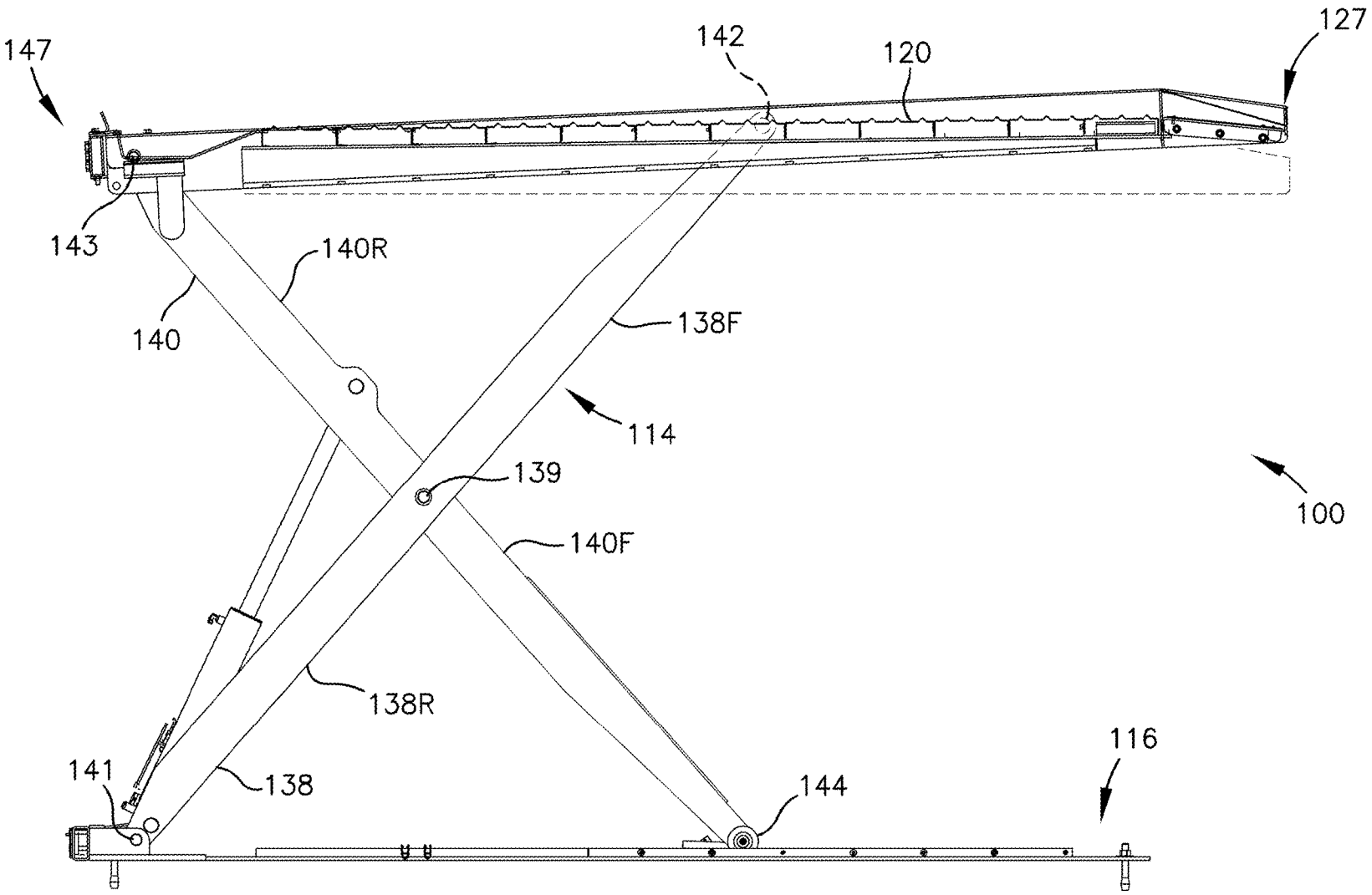
FIG. 8 is a side elevational view of a tilting vehicle parking lift in a lowered a raised condition depicted in accordance with an exemplary embodiment, with a lowered orientation of a platform of the lift shown in phantom lines.

In another embodiment depicted in FIGS. 7 and 8, the scissor-lifts 14 may be configured as tilting scissor-lifts 114 for a parking lift 100. The parking lift 100 and the tilting scissor-lifts 114 may be configured and operate identically to parking lift 10 and the scissor-lifts 14 but with a lower-pivot leg 138 or an upper-pivot leg 140 that is longer than the other of the legs 138, 140 so as to provide upward and/or rearward tilting of the platform 112. As depicted in FIGS. 7 and 8, the lower-pivot leg 138 is longer than the upper-pivot leg 140, but the opposite configuration may be employed without departing from the scope of exemplary embodiments described herein.

The lower-pivot leg 138 and the upper-pivot leg 140 each include a rearward section 138R, 140R and a forward section 138F, 140F. The rearward section 138R of the lower-pivot leg 138 is positioned between the pivot point 139 and the pivotal coupling 141 with the base 116 while the rearward section 140R of the upper-pivot leg 140 is positioned between the pivot point 139 and the pivotal coupling 143 with the frame 118. The forward section 138F of the lower-pivot leg 138 is disposed between the pivot point 139 and the roller 142 while the forward section 140F of the upper-pivot leg 140 is disposed between the pivot point 139 and the roller 144.

As depicted in FIG. 7, the rearward sections 138R, 140R are preferably substantially the same length. The forward section 140F of the upper-pivot leg 140 may be substantially the same length as the rearward sections 138R, 140R or may be slightly longer. As such, the pivot point 139 of the upper-pivot leg 140 may be generally centrally located along its length or may be slightly offset toward the rearward section 140R. The forward section 138F of the lower-pivot leg 138 is longer in length than each of the rearward sections 138R, 140R and the forward section 140F; the pivot point 139 of the lower-pivot leg 138 is thus not centrally located along its length and is closer to the pivotal coupling 141 than to the roller 142. As such, in the lowered position, the roller 142 of the lower-pivot leg 138 lies nearer to the entry end 127 of the platform 112 than the roller 144 of the upper-pivot leg 140.

When raised to the raised position from the lowered position, the roller 142 of the lower-pivot leg 138 is moved a greater vertical distance than the pivotal coupling 143 of the upper-pivot leg 140 and the frame 118. As the tilting scissor-lifts 114 raise the platform 112, the entry end 127 thereof is thus moved further vertically upward than a terminal or rear end 147 to tilt the platform 112 at least partially rearward, e.g. to pivot the platform 112 upwardly or rearwardly about the pivotal couplings 143. The lower- and upper-pivot legs 138, 140 may be configured to pivot the platform 112 to any desired extent, but preferably tilt the platform 112 between about 0° and about 25° or between about 2° and about 15° or between about 2° and about 10° or about 5° or about 2.5°. In one embodiment, the platform 112 is tilted upward a sufficient amount to place the deck 120 in a substantially level orientation or in a slightly rearward leaning orientation. Such tilting provides additional vertical clearance between the entry end 127 of the platform 112 and the underlying surface, i.e. the ground, and thus enables positioning of taller vehicles beneath the platform 112.

Many different arrangements of the various components depicted, as well as components not shown, are possible without departing from the scope of the claims below. Embodiments of the technology have been described with the intent to be illustrative rather than restrictive. Alternative embodiments will become apparent to readers of this disclosure after and because of reading it. Alternative means of implementing the aforementioned can be completed without departing from the scope of the claims below. Identification of structures as being configured to perform a particular function in this disclosure and in the claims below is intended to be inclusive of structures and arrangements or designs thereof that are within the scope of this disclosure and readily identifiable by one of skill in the art and that can perform the particular function in a similar way. Certain features and sub-combinations are of utility and may be employed without reference to other features and sub-combinations and are contemplated within the scope of the claims.

What is claimed is:

1. A parking lift for vehicles comprising:

a platform having a frame supporting a deck that is configured to receive a first vehicle thereon and support the first vehicle in a lowered and a raised position;

a pair of scissor-lift leg assemblies, each assembly including a first leg having a first length and a second leg having a second length that is shorter than the first length, the first and the second legs being pivotably coupled together at a pivot point that is offset from a midpoint of the first leg, a first proximate end of the first leg being pivotably coupled to a base and an opposite distal end of the first leg being configured to move along the platform, the second leg being pivotably coupled at a second proximate end to a terminal end of the platform and having an opposite distal end configured to move along the base, the first leg being pivotable relative to the second leg, the pivoting moving the distal end of the first leg a greater vertical distance than the second proximate end of the second leg and tilting an entry end of the deck vertically about the second proximate end of the second leg;

the platform being moveable between the lowered position in which an entry end of the deck is one of in contact with an underlying surface or in very close proximity to the underlying surface and the raised position in which the platform is positioned a sufficient vertical distance above the base to allow a second vehicle to be positioned below the platform; and wherein in the lowered position the deck is upwardly sloped from the entry end toward the terminal end relative to the underlying surface and in the raised position the deck is moved to be one of substantially level or downwardly sloped from the entry end toward the terminal end relative to the underlying surface.

2. The parking lift of claim 1, wherein the pivot point is located in a position that is a distance from the first proximate end that is substantially equal to half of the second length.

3. The parking lift of claim 1, wherein one or both of the scissor-lift leg assemblies includes a locking assembly.

4. The parking lift of claim 3, wherein the base includes a pair of longitudinally extending base plates and a cross-member extending between the base plates, and wherein the locking assembly includes an arm extending from the opposite distal end of the second leg, the arm including a trigger plate that is pivotably coupled to the arm and a locking tab that extends from the arm toward the respective base plate, and wherein the respective base plate includes a plurality of safety stops, the safety stops being engageable by the locking tab to prevent movement of the distal end of the second leg in one direction along the respective base plate.

5. The parking lift of claim 4, wherein the arm defines a slot extending through a thickness thereof and the trigger plate is disposed to extend through the slot, the slot defining a range of pivotal movement of the trigger plate.

6. The parking lift of claim 4, wherein the trigger plate is pivotable between a deployed orientation and an arming orientation, in the deployed orientation the trigger plate preventing the locking tab from engaging the safety stops and in the arming orientation the trigger plate enabling engagement of the locking tab with the safety stops.

7. The parking lift of claim 1 and including:

a wheel trough positioned at the terminal end of the platform to receive a wheel of a vehicle supported on the deck to resist movement of the vehicle thereon.

8. A parking lift for vehicles comprising:

a platform having a frame supporting a deck that is configured to receive a vehicle thereon;

a pair of scissor-lift leg assemblies, each assembly including a first leg having a first length and a second leg having a second length that is shorter than the first length, the first and the second legs being pivotably coupled together at a pivot point that is offset from a midpoint of the first leg, a first proximate end of the first leg being pivotably coupled to a base and an opposite distal end of the first leg being configured to move along the platform, the second leg being pivotably coupled at a second proximate end to a terminal end of the platform and having an opposite distal end configured to move along the base, the first leg being pivotable relative to the second leg, the pivoting moving the distal end of the first leg a greater vertical distance than the second proximate end of the second leg and tilting an entry end of the platform vertically about the second proximate end of the second leg;

wherein the second leg includes a recessed portion on a surface closest to a longitudinally extending midline of the parking lift, the recessed portion extending along a portion of the length of the second leg and being recessed away from the midline.

9. The parking lift of claim 8, further comprising: a pad coupled to the second leg within the recessed portion.

10. A parking lift for vehicles comprising:

a platform having a frame supporting a deck that is configured to receive a vehicle thereon;

a pair of scissor-lift leg assemblies, each assembly including a first leg having a first length and a second leg having a second length that is shorter than the first length, the first and the second legs being pivotably coupled together at a pivot point that is offset from a midpoint of the first leg, a first proximate end of the first leg being pivotably coupled to a base and an opposite distal end of the first leg being configured to move along the platform, the second leg being pivotably coupled at a second proximate end to a terminal end of the platform and having an opposite distal end configured to move along the base, the first leg being pivotable relative to the second leg, the pivoting moving the distal end of the first leg a greater vertical distance than the second proximate end of the second leg and tilting an entry end of the platform vertically about the second proximate end of the second leg; and an ear extending vertically downward from the frame of the platform, in the lowered position the ear contacting the base and the platform pivoting about a contact point between the ear and the base.

11. A parking lift for vehicles comprising:

a platform having a frame supporting a deck that is configured to receive a vehicle thereon;

a pair of scissor-lift leg assemblies, each assembly including a first leg having a first length and a second leg having a second length that is shorter than the first length, the first and the second legs being pivotably coupled together at a pivot point that is offset from a midpoint of the first leg, a first proximate end of the first leg being pivotably coupled to a base and an opposite distal end of the first leg being configured to move along the platform, the second leg being pivotably coupled at a second proximate end to a terminal end of the platform and having an opposite distal end configured to move along the base, the first leg being pivotable relative to the second leg, the pivoting moving the distal end of the first leg a greater vertical distance than the second proximate end of the second leg and tilting an entry end of the platform vertically about the second proximate end of the second leg;

wherein one or both of the scissor-lift leg assemblies includes a locking assembly;

wherein the base includes a pair of longitudinally extending base plates and a cross-member extending between the base plates, and wherein the locking assembly includes an arm extending from the opposite distal end of the second leg, the arm including a trigger plate that is pivotably coupled to the arm and a locking tab that extends from the arm toward the respective base plate, and wherein the respective base plate includes a plurality of safety stops, the safety stops being engageable by the locking tab to prevent movement of the distal end of the second leg in one direction along the respective base plate;

wherein the trigger plate is pivotable between a deployed orientation and an arming orientation, in the deployed orientation the trigger plate preventing the locking tab from engaging the safety stops and in the arming orientation the trigger plate enabling engagement of the locking tab with the safety stops; and wherein the trigger plate provides an over-center condition between the deployed orientation and the arming orientation.

12. A parking lift for vehicles comprising:

a platform configured to receive and support a vehicle thereon; a pair of scissor-lift leg assemblies disposed beneath the platform, each assembly including a first leg having a first length and a second leg having a second length that is shorter than the first length, the first and second legs being pivotably coupled together at a pivot point, a second proximate end of the second leg being coupled to the platform near a terminal end of the platform, the second leg having a recessed portion on a surface closest to a longitudinally extending midline of the parking lift, the recessed portion extending along a portion of the length of the second leg between a second distal end of the second leg and the pivot point and being recessed away from the midline; and an actuator coupled to at least one of the first and the second legs and operable to pivot the first leg relative to the second leg to raise and lower the platform vertically, the pivoting moving a first distal end of the first leg a greater vertical distance than the second proximate end of the second leg and tilting the platform vertically about the second proximate end of the second leg.

13. The parking lift of claim 12, wherein the first leg is pivotably coupled to the second leg at a pivot point that is located in a position along the first length of the first leg that is a distance from a first proximate end of the first leg that is substantially equal to half of the second length.

14. The parking lift of claim 12, wherein the platform is moveable between a lowered position in which an entry end of the deck is one of in contact with an underlying surface or in very close proximity to the underlying surface, and a raised position in which the platform is positioned a sufficient vertical distance above the base to allow a vehicle to be positioned below the platform, in the raised position the deck is moved to be one of substantially level or downwardly sloped from the entry end toward the terminal end relative to the underlying surface.

15. The vehicle parking lift of claim 12, further comprising: a pad disposed on the first leg in the recessed portion.

16. The parking lift of claim 12, further comprising: a locking assembly including an arm pivotably coupled to and extending from the first distal end of the first leg, the arm including a trigger plate that is pivotably coupled to the arm and a locking tab that extends from the arm toward a base plate underlying the scissor-lift leg assembly, the base plate including a plurality of safety stops, the safety stops being engageable by the locking tab to prevent movement of the distal end of the first leg in one direction along the respective base plate.

17. A parking lift for vehicles comprising:

a platform having a frame supporting a deck having an entry end and a terminal end with an entry panel extending across an entry end of the deck, wherein the deck is configured to support a first vehicle thereon in a lowered and a raised position;

a pair of scissor-lift leg assemblies for moving the platform between the lowered position and the raised position, each scissor-lift leg assembly including a first leg having a first length and a second leg having a second length that is shorter than the first length, the first and the second legs being pivotably coupled together at a pivot point that is offset from a midpoint of the first leg, a first proximate end of the first leg being pivotably coupled to a base and an opposite distal end of the first leg being configured to move along the platform, the second leg being pivotably coupled at a second proximate end to a terminal end of the platform and having an opposite distal end configured to move along the base, the first leg being pivotable relative to the second leg, the pivoting moving the distal end of the first leg a greater vertical distance than the second proximate end of the second leg and tilting an entry end of the deck vertically about the second proximate end of the second leg as the pair of scissor-lift leg assemblies moves the platform to the raised position;

the platform being moveable by the pair of scissor-lift leg assemblies, in the lowered position an entry end of the entry panel is in contact with an underlying surface or in very close proximity to the underlying surface;

when the deck is in the lowered position, an entry end of the entry panel is in contact with an underlying surface or in very close proximity to the underlying surface, the entry panel is upwardly sloped from the entry end of the entry panel to the entry end of the deck at a first angle relative to the underlying surface, the deck is upwardly sloped from the entry end of the deck toward the terminal end of the deck at a second angle relative to the underlying surface and wherein the first angle is greater than the second angle; and when the deck is in the raised position, the deck is moved to be one of substantially level or downwardly sloped from the entry end of the deck toward the terminal end of the deck relative to the underlying surface.

18. The parking lift of claim 17 and including:

a wheel trough positioned at the terminal end of the platform to receive a wheel of a vehicle supported on the deck to resist movement of the vehicle thereon.

* * * * *